United States Patent [19]

Blower et al.

[11] 4,261,413

[45] Apr. 14, 1981

[54] FOUNDRY MOLDING SYSTEM

[75] Inventors: Warren A. Blower, Brecksville; Gilbert J. Janke, Parma, both of Ohio; Marcel Weinstein, Thiais, France

[73] Assignee: The Osborn Manufacturing Corporation, Cleveland, Ohio

[21] Appl. No.: 940,383

[22] Filed: Sep. 7, 1978

[51] Int. Cl.[3] ..... B22C 9/00

[52] U.S. Cl. ..... 164/159; 164/168; 164/323; 164/374; 164/375

[58] Field of Search ..... 164/6, 15, 18, 23, 27, 164/29, 159, 167, 168, 180, 181, 183, 224, 322, 323, 185, 402, 409, 137, 339, 374, 384; 92/9; 198/614, 577

[56] References Cited

U.S. PATENT DOCUMENTS

| | | | |
|---|---|---|---|
| 2,850,775 | 9/1958 | Northington, Jr. et al. | 164/168 |
| 3,123,871 | 3/1964 | Taccone | 164/168 |
| 3,250,370 | 5/1966 | Adams | 198/614 |
| 3,759,364 | 9/1973 | Kornylak | 198/614 |

FOREIGN PATENT DOCUMENTS

| | | | |
|---|---|---|---|
| 2548577 | 5/1977 | Fed. Rep. of Germany | 164/323 |
| 51-16163 | 5/1976 | Japan | 164/323 |
| 1313294 | 4/1973 | United Kingdom | 92/9 |

*Primary Examiner*—Robert D. Baldwin
*Assistant Examiner*—K. Y. Lin
*Attorney, Agent, or Firm*—Maky, Renner, Otto & Boisselle

[57] ABSTRACT

A foundry molding system for molding and closing cope and drag molds includes a linear idler molding line conveyor adjacent a cooling conveyor. Short powered sections are provided at each end of the molding line conveyor for set-off from the cooling conveyor to form the assembled cope and drag flasks into horizontally abutting drag and cope sets on the molding line conveyor and for closing and setting on the cooling conveyor the assembled cope and drag molds. Reciprocating index and control means are provided at each end of the molding line conveyor for indexing the sets therealong in abutting relationship. Powered roller detents or locaters are provided along the conveyor to hold the flasks to separate, center and retain the flasks for a variety of operations such as set-down, molding, drag rollover, coring, closing and set-on. The roller detents at the drag rollover are located in the trunnions of the rollover for operation therewith. Both cope and drag flasks are constructed to cooperate with the rollers of the detents.

44 Claims, 21 Drawing Figures

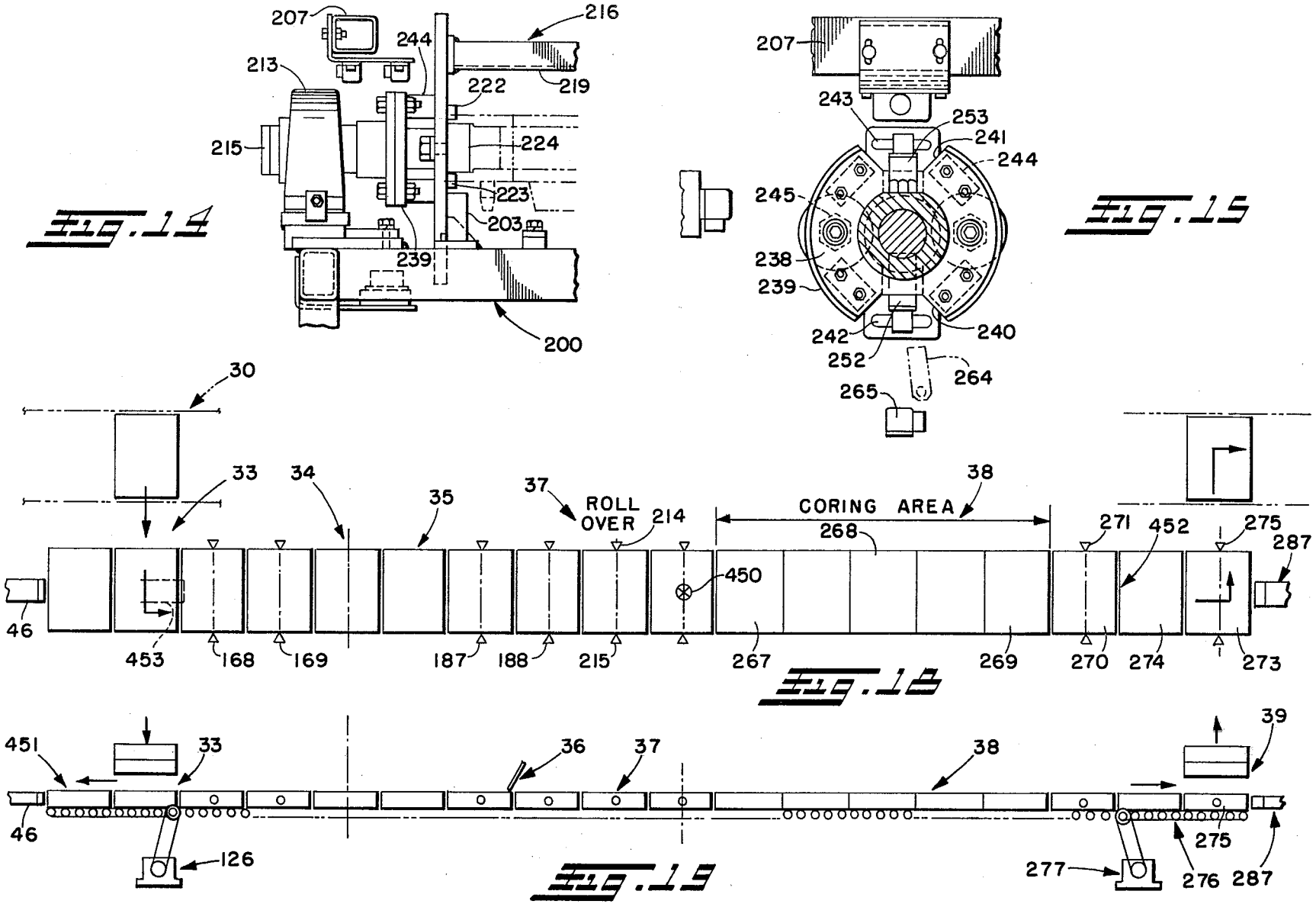
CORING AREA
ROLL OVER
207
213
215
216
219
222
224
223
203
200
244
239
253
241
243
245
238
240
242
252
264
265
30
33
34
35
37
38
39
36
46
126
168
169
187
188
214
215
267
268
269
270
271
273
274
275
276
277
287
450
451
452
453

FOUNDRY MOLDING SYSTEM

This invention relates generally as indicated to a foundry molding system and method and more particularly to a simplified foundry molding line for producing cope and drag molds.

BACKGROUND OF THE INVENTION

Present day automatic high production foundry installations utilize high pressure squeeze molding machines to form cope and drag molds which are then cored, if necessary, and assembled to form completed foundry molds. The molds are then placed on a pouring and cooling conveyor for casting. After the casting has cooled, the mold is punched out to remove the sand and casting therefrom. The cope and drag flasks are then separated and recycled through the molding line.

In high production units for large size flasks, the molding lines may either be "in-line" or "cross-loop" systems. In a "cross-loop" system the cope and drag molds are generally molded separately in parallel conveyor systems each crossing a loop of a pouring and cooling conveyor. In an "in-line" system the molding line generally extends parallel to the pouring and cooling conveyor and the cope and drag flasks are conveyed through the molding line in sets of alternating cope and drag flasks. The molding machines are then next to each other on a single conveyor. Both "in-line" and "cross-loop" mold production units have been manufactured for many years by The Osborn Manufacturing Corporation of Cleveland, Ohio.

In conventional "in-line" molding systems the flasks are driven through the molding line by a number of clutch and brake operated powered conveyor rolls which require relatively sophisticated and expensive controls so that each flask will be properly positioned for the variety of operations which must be performed thereon.

Typically, the mold with the cool casting therein is placed on the entrance of the molding line and after the casting and sand has been punched from the mold, the cope and drag flask are cleaned and separated. The cope and drag are then set into the cope and drag molding machines which conventionally include a vertically elevating table which includes a pattern plate. The sand filled flask is elevated against a squeeze board to form the pattern impression on the lower face of the mold thus formed in the flask. The mold is then replaced on the molding line conveyor. Such molds now move to a coring station but between the mold and the coring station, the drag is inverted so that the pattern cavity in the mold face is facing upwardly. After coring, the molds are assembled with the cope on top and the drag on the bottom and then replaced on the pouring and cooling conveyor.

For each of the above described operations, the cope and drag flasks must be relatively precisely centered and must be slightly spaced from each other to avoid interference. Accordingly, when a power driven conveyor is employed, the conveyor itself and particularly the controls for the drives can become inordinately expensive in addition to being a very high maintenance item.

It would of course be desirable if the sets of cope and drag flasks could be simply pushed through the molding line in abutting relationship; however, some means must be found to center and separate the flasks for each of the above noted operations. Moreover, when the flasks are again indexed by pushing, the slack or spacing between the flasks will be taken up, and like the last car on a railroad train, a flask may be subjected to a substantial jolt or bump when the slack is taken out of the line. This can cause damage or disintegration to a mold previously formed and can of course damage a flask. Accordingly, molding lines which employ abutting flasks pushed along an idler conveyor have numerous drawbacks which limit both productivity and reliability.

SUMMARY OF THE INVENTION

The present invention utilizes a linear idler roller conveyor utilizing flanged idler rollers journaled on stub shafts projecting inwardly from conveyor rails to support the cope and drag flasks on the flanged lower side edges thereof. Relatively short powered roller sections are provided at the entrance and exit of the idler roller section for disassembly and assembly in the set-off and closing operations. The set-off forms horizontally abutting or juxtaposed sets of the cope and drag flasks.

Indexing and control means at both ends of the conveyor move such sets in abutting relation along the conveyor under controlled conditions. The stroke of the indexing means is slightly longer than a single set of a cope and drag flask. Positioned strategically along the conveyor are opposed sets of power operated roller detents or locaters which cooperate with horizontally spaced bars forming a detent receptacle on each flask. Such detents separate and center the flasks for the various operations. The drag rollover includes an opposed roller detent set mounted in the trunnions of the rollover to hold and lock the drag flask in the rollover during inversion.

It is accordingly a principal object of the present invention to provide a molding line and method utilizing a relatively inexpensive idler roller conveyor.

Another important object is the provision of a foundry molding line wherein the sets of cope and drag flasks are indexed therealong in abutting relationship.

Still another important object is the provision of such molding line utilizing powered roller detent means for holding and centering the flasks at a variety of strategic locations along the conveyor.

A further important object is the provision of such molding line incorporating a drag rollover wherein the roller detent means are provided in the trunnions of the rollover to lock and center the drag mold for inversion.

A further object is the provision of a molding line utilizing indexing and control means at the entrance and exit of the conveyor for conveying the flasks therealong under controlled conditions.

Another object is the provision of such indexing means which will index the flasks a distance slightly more than the horizontal length of a single set.

Still another object is the provision of the combination of a foundry flask including a centrally located centering receptacle and a laterally movable roller somewhat larger in diameter than the receptacle operative to engage the flask at the receptacle to center and retain the flask at a given location along the molding line.

A still further object is the provision of a molding system as set forth above wherein the flasks are indexed therealong by fluid power index and control cylinders at each end of the conveyor operative to move the flask sets therealong, each including a relatively long stroke pneumatic piston-cylinder and a control hydraulic piston-cylinder in parallel thereto.

Finally, it is an object of the present invention to provide a low cost yet reliable high production foundry molding system and method.

Other objects and advantages of the present invention will become apparent as the following description proceeds.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

BRIEF DESCRIPTION OF THE DRAWINGS

In said annexed drawings:

FIG. 8 is a side elevation similar to FIG. 6 but of the cope flask;

FIG. 14 is a fragmentary side elevation of the trunnion of FIG. 13;

FIG. 15 is a fragmentary vertical section taken substantially on the line 15—15 of FIG. 13;

FIG. 16 is a broken away vertical section of one of the cope hold down rods as employed in the closing machine;

FIG. 19 is a schematic elevation corresponding to FIG. 18.

THE MOLDING LINE—GENERAL ARRANGEMENT—FIGS. 1 and 2

The molding line comprises for the most part an idler conveyor shown generally at 20 which includes parallel side rails 21 and 22 which are supported above the floor 23 by legs 24 and the legs of the components of the molding line as hereinafter described. The side rails of the conveyor are horizontal and parallel and are formed in segments which tie the various components of the molding line together within certain relatively close tolerances.

Figure 2B:
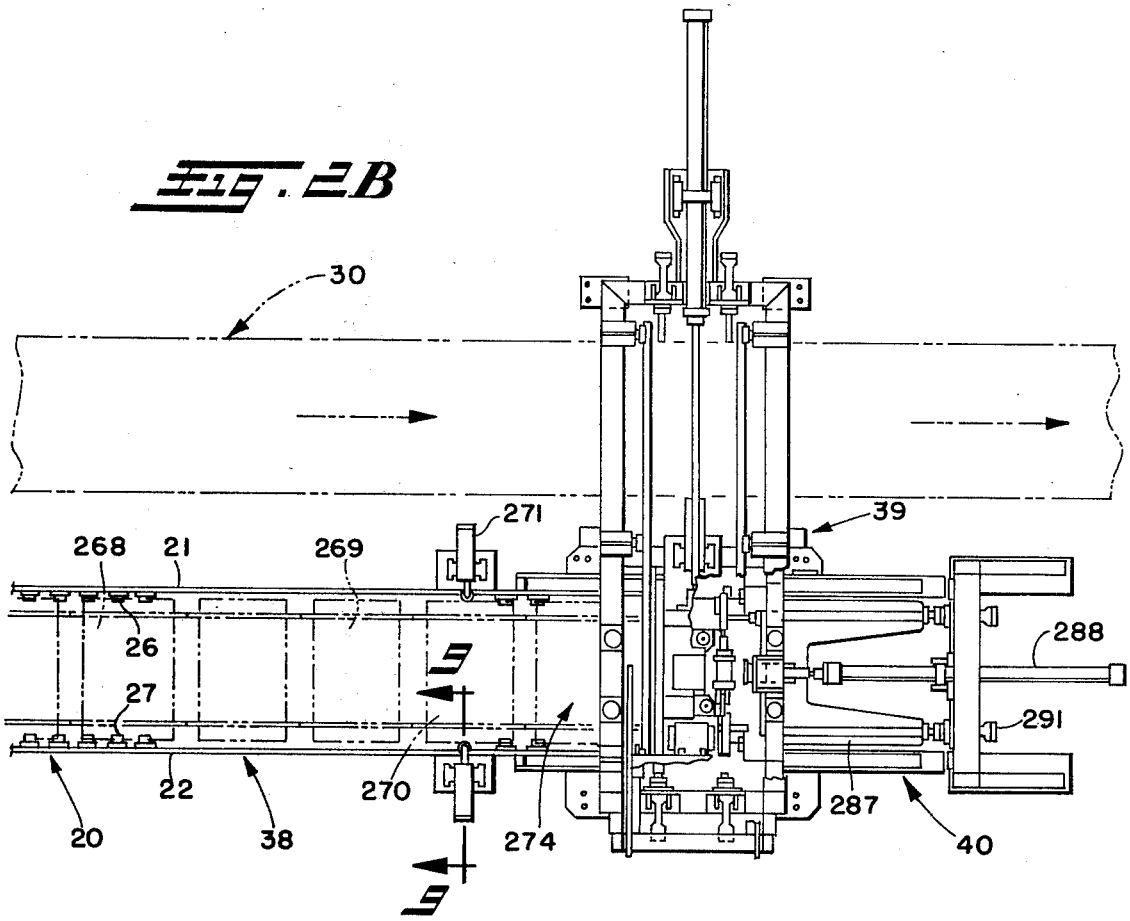
FIG. 2A and FIG. 2B are broken continuations of each other illustrating the molding line of FIGS. 1A and 1B in plan view as seen from the lines 2A—2A and 2B—2B of FIGS. 1A and 1B, respectively.

Projecting inwardly from each conveyor rail are flanged idler rollers seen at 26 and 27 in FIG. 2B, each such roller being journaled on a stub shaft secured to the respective conveyor side rail. Such flanged idler rollers may be of the type sold by The Osborn Manufacturing Corporation of Cleveland, Ohio under the trademark LOAD RUNNERS.

The molding line conveyor 20 extends generally parallel and adjacent to a bottom board or like conveyor 30 which constitutes the pouring and cooling conveyor of the foundry system.

The components of the molding line reading from left to right in FIGS. 2A and 2B or 1A and 1B are the mold line index mechanism 32, a flask set-off and separate machine 33, a drag molding machine 34, a cope molding machine 35, a drag mold strike-off 36, a drag rollover 37, a coring section 38, a mold case and set-on machine 39, and a mold line index control 40.

Figure 2A:
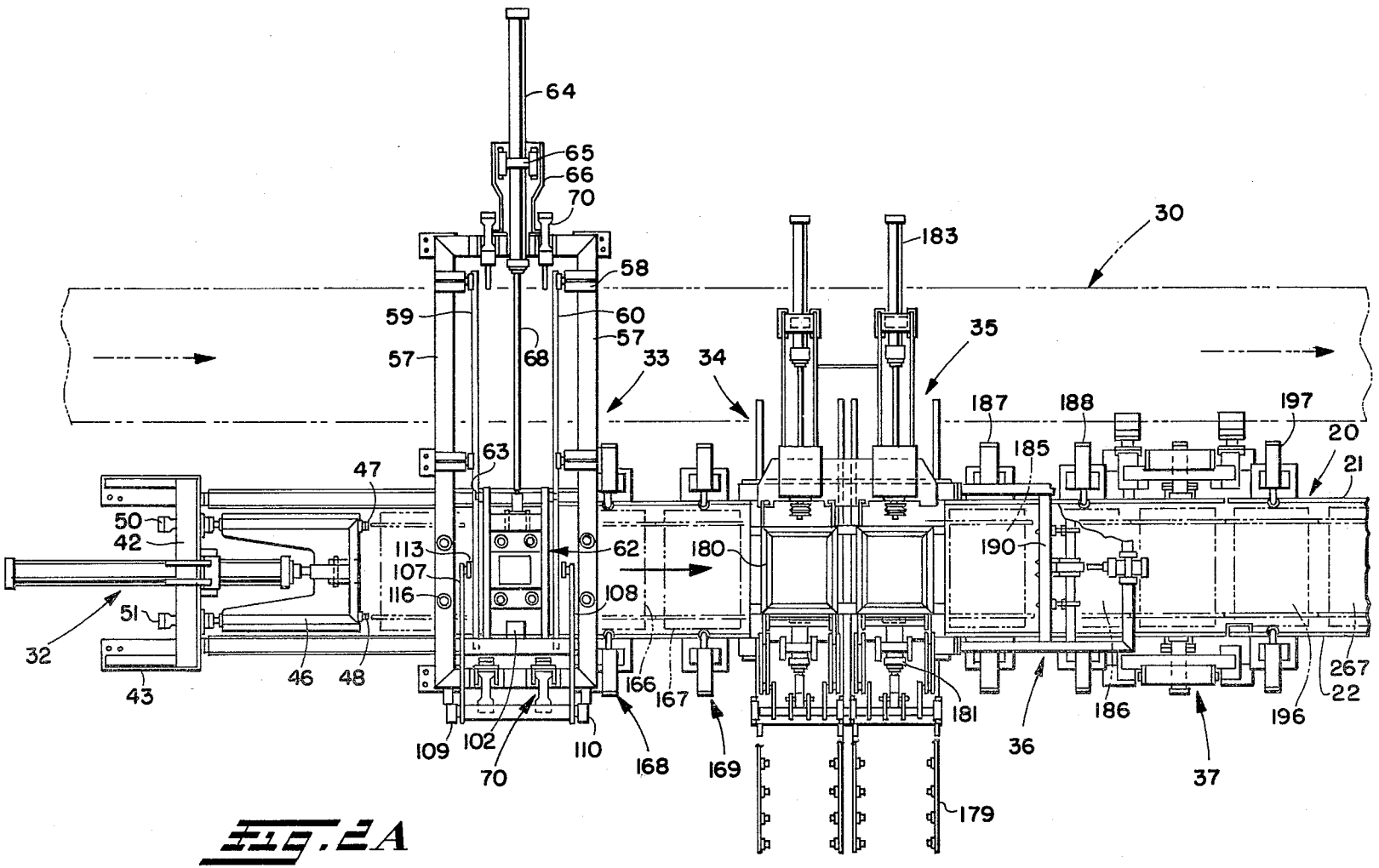

The mold line index mechanism 32 is generally similar to the mold line index control 40 but faces in the opposite direction. The mold line index mechanism 32 is mounted on a transverse frame 42 supported at each side by asymmetrical A-frames. The mold line index 32 comprises a relatively large pneumatic piston-cylinder assembly 44 and a somewhat smaller hydraulic piston-cylinder assembly 45, the rods of both of which are in parallel and connected to pusher frame 46. The cylinders are connected to the frame 42. The pusher frame on its forward end includes urethane or like bumpers 47 and 48. As indicated in FIG. 2A, the pusher frame 46 is U-shape in plan and the frame 42 includes two shock absorbers 50 and 51 which engage the pusher frame legs in the retracted position thereof as shown in FIG. 2A.

The flask set-off and separate machine 33 is substantially identical to the mold close and set-on machine 39 and accordingly only the machine 33 will be described in detail.

Figures 3, 18:
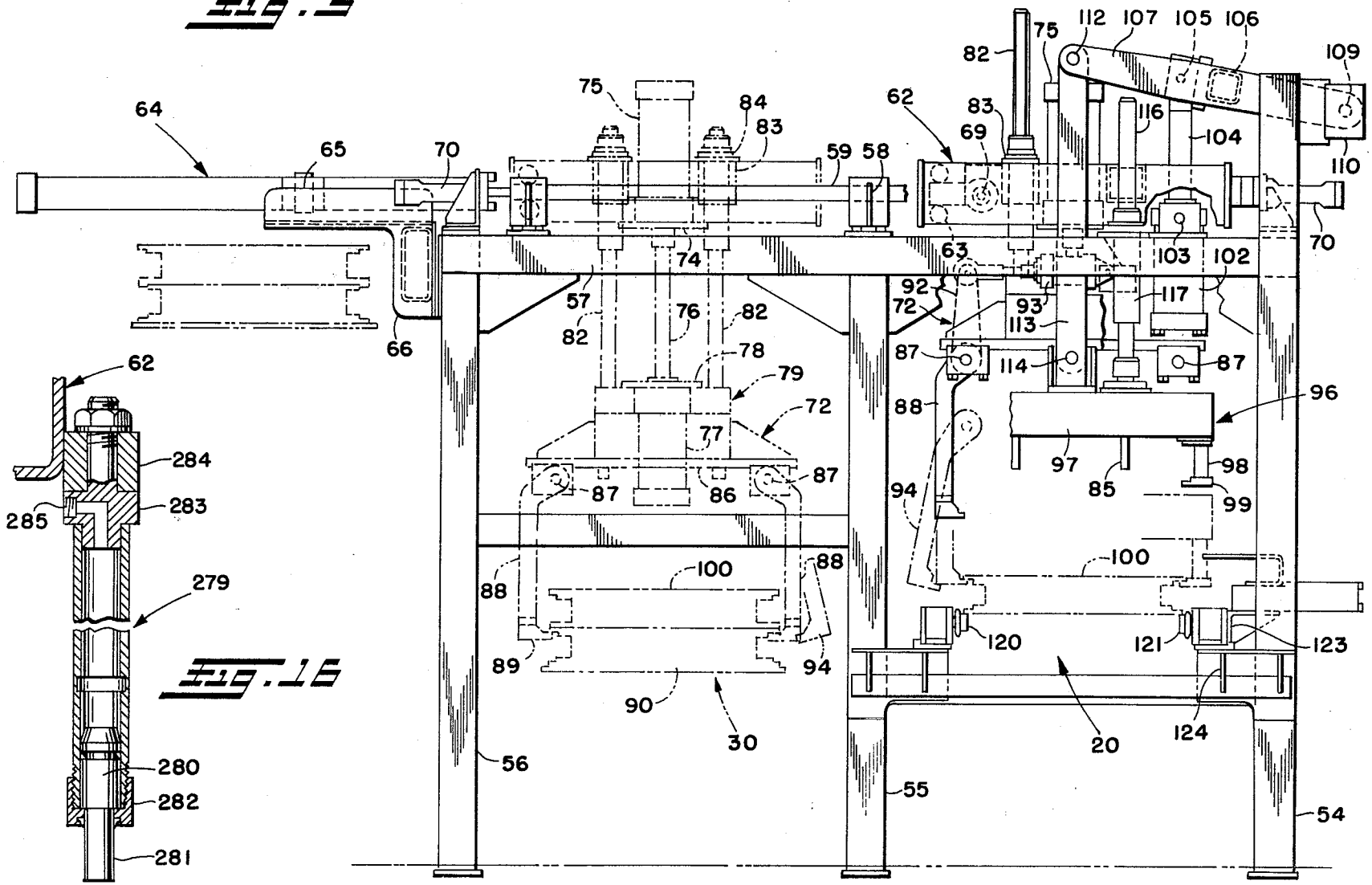
FIG. 3 is an enlarged elevation of the set-on and separate machine at the entrance of the molding line as seen from the line 3—3 of FIG. 1A.
FIG. 18 is a schematic top plan view of the molding line illustrating the flow of the flasks therethrough and showing the position of the flasks with the locater or detent means in locking position intermediate the index cycle.

Referring now additionally to FIG. 3 it will be seen that the machine 33 includes a fabricated frame having three pairs of legs indicated at 54, 55 and 56, with the pairs 54 and 55 straddling or, more correctly, supporting the idler conveyor 20 while the legs 55 and 56 straddle the pouring and cooling conveyor 30. The top of the legs are interconnected by parallel frame members 57 which in turn support inwardly cantilevered brackets 58 to which in turn are secured parallel carriage rails 59 and 60. There may be three brackets on each side and such brackets support the rails substantially inwardly spaced from the top frame members 57. Supported on the rails for movement therealong is a generally H-shape carriage seen at 62. The carriage includes four sets of rolls seen at 63 riding over and under the rails 59. The carriage is powered for horizontal reciprocating movement by a relatively long stroke piston-cylinder assembly seen at 64. The cylinder of such assembly is pivoted at 65 on L-shaped bracket 66 extending from the top of the frame. The rod 68 of such assembly is pivotally connected at 69 to the carriage 62. A pair of shock absorbers as seen at 70 may be provided at each end of the travel of the carriage 62 engaging the ends of the legs of the H of the carriage.

The carriage 62 supports a drag pick-up seen generally at 72. The carriage includes a flange or a plate 74 bridging the legs of the H to which is secured cylinder 75. The rod 76 of the cylinder 75 is also the rod of opposed cylinder 77 which is secured to plate 78 of elevator frame 79. In this manner the opposed cylinders 75 and 77 have a common interconnecting piston rod. The elevator frame also includes upwardly projecting guide rods 82 which extend through guide bushings 83 in turn secured to the horizontal plates 84 bridging the legs of the H. There may be four such guide rods and bushings. Also projecting downwardly from the carriage 62 are four stop rods 85 against which the cope is elevated by the drag to secure the assembly for transfer.

Figure 1A:
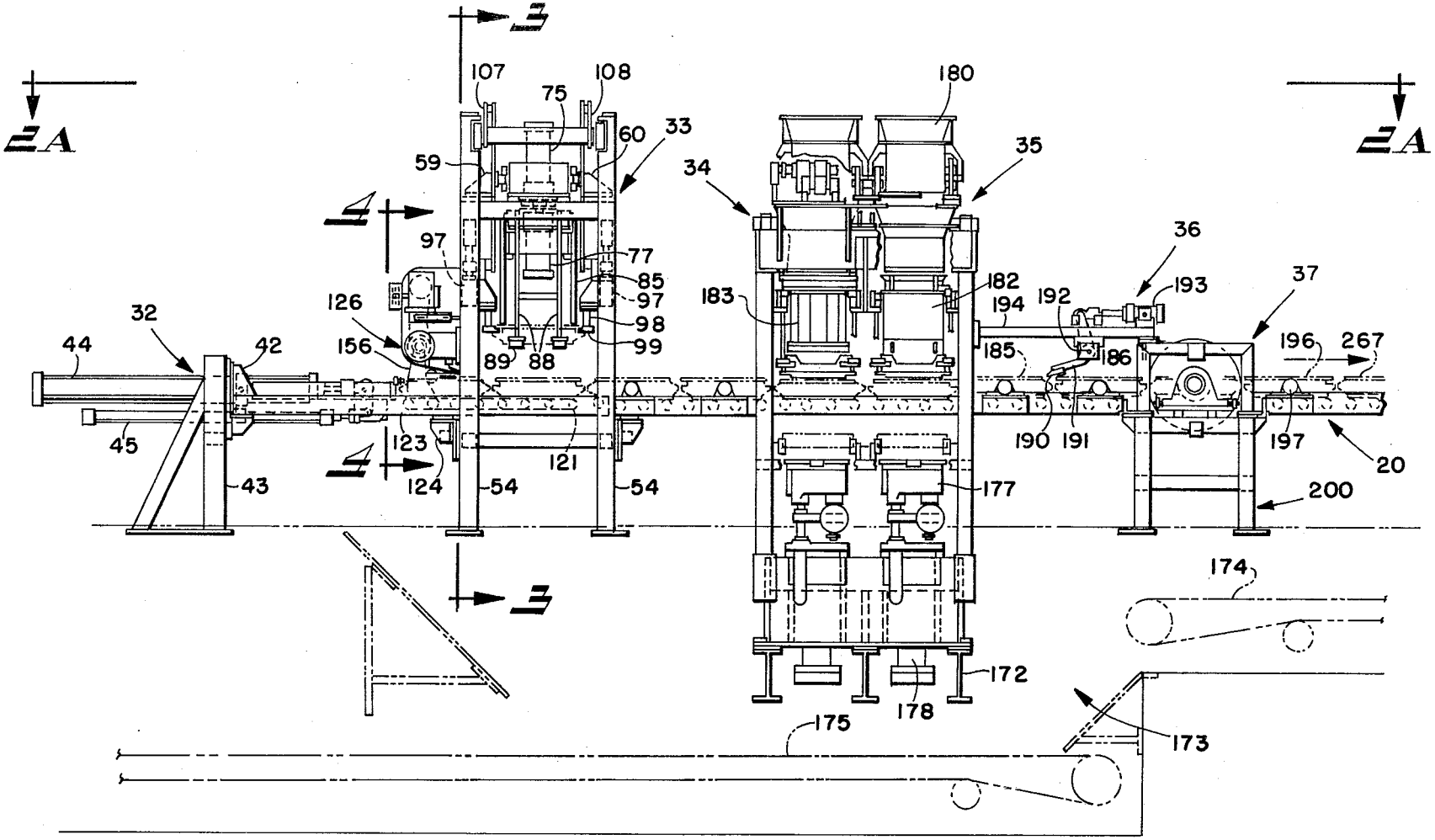
FIG. 1A and FIG. 1B are broken continuations of each other illustrating in side elevation a molding line in accordance with the present invention.

The elevator 79 includes a horizontal plate 86 and journaled to the underside thereof are parallel shafts 87 to which are secured drag pick-up arms 88, there being two such arms secured to each shaft as seen in FIG. 1A. Each arm is provided at its lower end with an L-shape shoe 89 designed to fit beneath the top flange of the drag flask 90 which will hereinafter be described in detail.

Each shaft 87 has secured thereto an upwardly projecting arm 92 as seen in FIG. 3, such arms being interconnected by relatively short stroke piston-cylinder assembly 93. The piston-cylinder assembly thus becomes an extensible link interconnecting the arms 92. It will readily be appreciated that when the piston-cylinder assembly 93 is extended the arms 88 will pivot toward each other. When the piston-cylinder assembly is retracted, the arms will swing to the clear or retracted position seen at 94.

The drag pick-up only moves with the carriage 62. The cope pick-up shown generally at 96 simply moves vertically above the conveyor 20.

The cope pick-up 96 comprises a pair of parallel frames 97. Inwardly and downwardly from each end of the parallel frames 97 project cope pick-up arms 98 which include inwardly projecting shoes 99 adapted to engage the upper flange of the cope 100 as hereinafter described. From FIGS. 1A and 3, it will be apparent that the arms 98 are L-shape and that the short leg of the arm projects horizontally toward the center of a cope supported thereby and the long leg of the arm projects vertically and clears the cope whether moved laterally or longitudinally with respect thereto. It is noted that the arms 98 are clear of the cope and its flange both in a direction parallel to the conveyor 20 as seen in FIG. 3 and in a direction normal to such conveyor as seen in FIG. 1A.

The cope pick-up frames 97 are moved vertically by piston-cylinder assembly 102 which is pivoted at 103 to the frame of the machine. The rod 104 projects upwardly and is pivoted at 105 to transverse frame 106 interconnecting arms 107 and 108. The proximal end of each arm is interconnected by a squaring shaft 109 pivoted between brackets 110 secured to the extension of the legs 54. Pivotally connected to the distal end of each arm as indicated at 112 is a vertically extending link 113 which is pivotally connected at 114 to the respective frame 97.

Each frame 97 includes a pair of upwardly extending guide rods 116 projecting through guide bushings 117 secured to the horizontal frame member 57.

Extension of the piston-cylinder assembly 102 will cause the arms 107 and 108 to pivot about the axis of squaring shaft 109 elevating the links 113 and thus the cope pick-up shoes 97. Retraction will of course lower the cope pick-up shoes.

It is noted that the links and frames straddle the drag pick-up elevator on the outside thereof and the rod 104 of the piston-cylinder assembly 102 projects upwardly through the legs of the H of the carriage 62 when the carriage is in the full-line extended position seen in FIG. 3.

In operation, as seen in FIG. 3, the carriage will be retracted to the phantom line position shown and the elevator lowered to pick up a cope and drag flask combination on the conveyor 30. At this point, the cope and drag flask combination may have already moved through a punch out which may be to the left of the conveyor 30 as seen in FIG. 3. When the piston-cylinder assembly 93 is extended, the drag pick-up arms 88 will pivot toward each other engaging beneath the top flange of the drag 90. The elevator is now elevated by retraction of both the piston-cylinder assemblies 75 and 77. The flask assembly is picked up against the stop rods 85 to be held at a required elevation.

The carriage is now extended to the right with the cope frames and cope supporting shoes 99 previously elevated by the extension of the piston-cylinder assembly 102. The top flange of the cope now moves slightly above the cope engaging shoes 97. At this point one of the piston-cylinder assemblies 75 or 77 may be extended to lower the elevator frame 72 to deposit the drag 90 on the flanged conveyor rolls 120 and 121 projecting inwardly from the frames 122 and 123, respectively, supported on the brackets 124 of the frame of the machine 33. When the drag is positioned on such rolls, the arms are retracted to the position 94 and the elevator 72 may be returned to its up position. As the drag is lowered to the rolls, the cope of course will be retained in its elevated position by engagement with the cope retaining shoes 99.

Figures 4, 5:
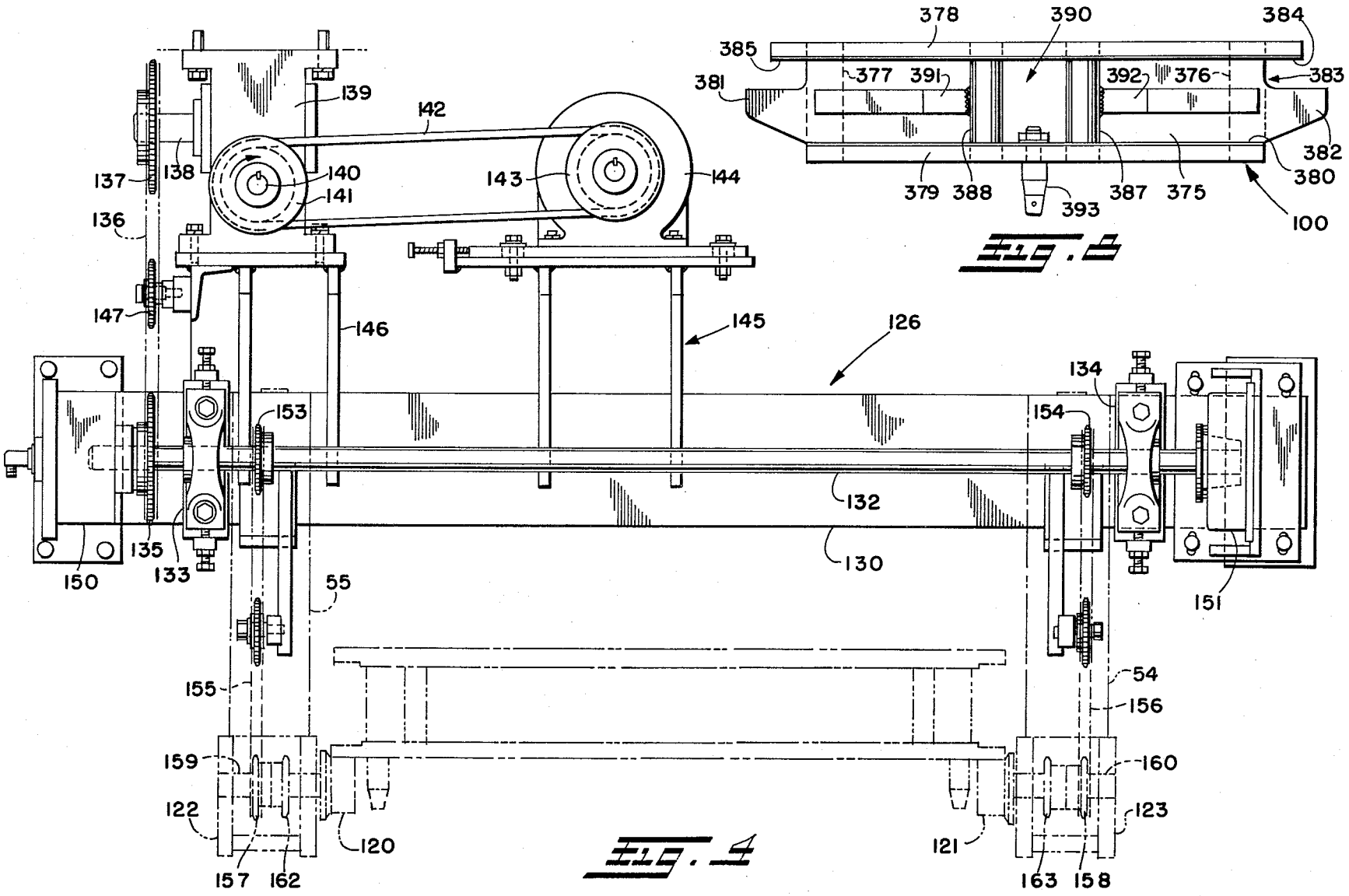
FIG. 4 is an enlarged elevation of the drive for the relatively short section of the conveyor at the entrance of the molding line as seen from the line 4—4 of FIG. 1A.
FIG. 5 is an enlarged top plan view of the drag flask for use with the present invention.
Figure 5:
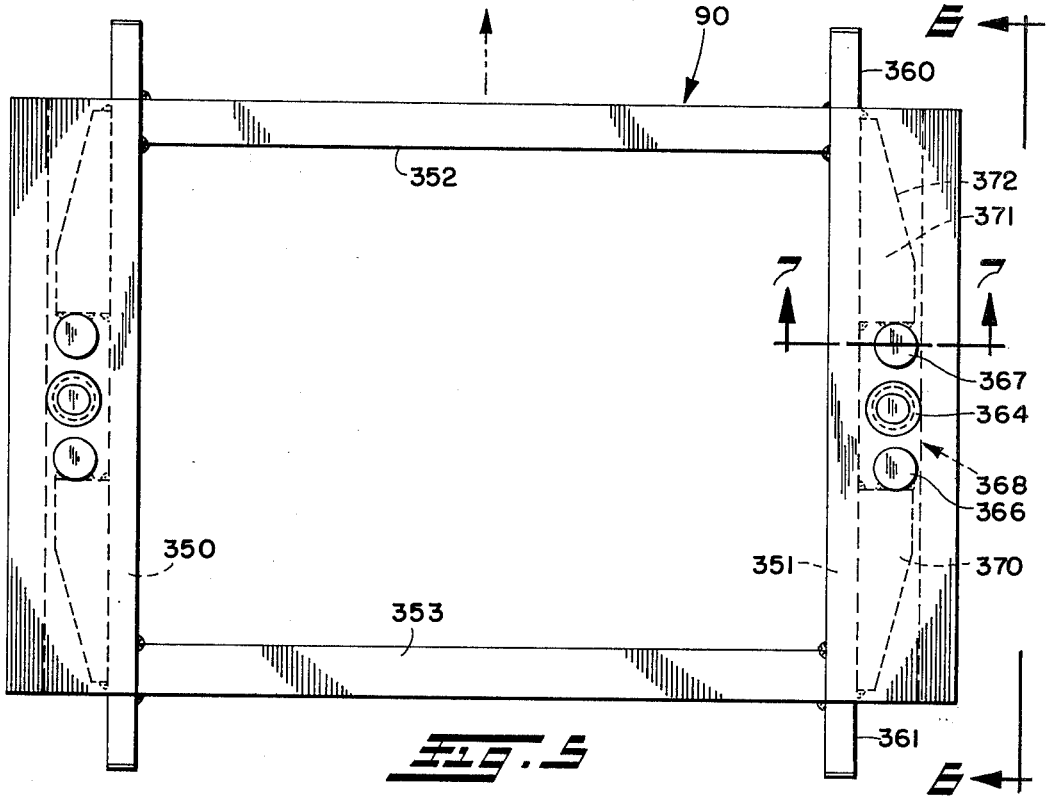

It is noted that the rolls 120 and 121 at the set-on machine 33 are power driven by the clutch and brake unit shown generally at 126 in FIG. 1A and in detail in FIG. 4. The purpose of the relatively short power driven conveyor section is to move the drag flask 90 rearwardly to clear the rolls 120 and 121 so that the cope 100 may then be set on the conveyor 20. The piston-cylinder assembly 102 is now retracted lowering the cope to the position seen in FIG. 3. The machine 33 has thus taken a vertically assembled cope and drag set and transferred it from the conveyor 30 to the conveyor 20 to form a set of a drag and cope flask horizontally aligned and in position adjacent the index frame bumpers 47 and 48 as seen in FIG. 2A. The cope frames 97 remain in their lower position until the indexer has cleared the horizontally aligned drag and cope set from the set-on machine. When the set is cleared, the cope frames are elevated to the position shown in full lines in FIG. 3 and the machine 33 may then recycle to position another cope and drag flask set in the same manner.

Referring now to FIG. 4 it will be seen that the clutch and brake drive 126 for the flanged rollers 120 and 121 includes a main transverse tubular frame 130 extending between the legs 54 and 55 on one side of the machine 33 above the conveyor 20. A line shaft 132 is journaled on such frame 130 by means of adjustable pillow blocks seen at 133 and 134. Such shaft is driven by sprocket 135 in turn driven from chain 136 in turn driven by sprocket 137 on the output shaft 138 of right angle speed reducer 139. The input shaft 140 of the speed reducer is driven by sheave 141 in turn driven by belt 142 from sheave 143 of motor 144. The motor is adjustably supported on frame 145 from the transverse frame 130. The speed reducer is also similarly supported by frame 146. An idler chain tightening sprocket 147 is adjustably supported from such frame.

Operatively connected to one end of the shaft 132 is a clutch 150. The opposite end of the shaft has operatively connected thereto a brake 151. The brake 151 may be disengaged independently of the operation of the clutch.

The shaft 132 is provided with two relatively small sprockets seen at 153 and 154 each driving chains 155 and 156, respectively, tightened by the adjustable tensioning sprockets shown. Such chains extend about sprockets 157 and 158 on the shafts 159 and 160, respectively, of two adjacent rollers 120 and 121 on each side of the powered section of the conveyor, as seen perhaps more clearly in FIG. 1A.

Such shafts are provided with additional sprockets as seen at 162 and 163 so that the other rollers in the powered section of the conveyor may also be driven from the shaft 132. The powered section of the conveyor is relatively short and only long enough to permit a drag flask to be moved rearwardly adjacent the index pusher so that a cope flask may be set-off the conveyor immediately in front thereof.

After the drag and cope set is thus formed by the set-on machine, the clutch and brake are both disengaged and the index mechanism then pushes the horizontally abutting drag and cope flasks to the right as seen in FIGS. 1A and 2A to clear the machine 33. When the index mechanism is retracted, a new set of drag and cope flasks will be similarly positioned on the conveyor.

From the set-off machine the drag and cope flasks then move into the positions seen at 166 and 167 wherein they are retained or held against movement by opposed pairs of locater or detent means seen at 168 and 169. Such retainers will hereinafter be described in greater detail.

The drag flask held in the position 166 will be held clear of the set-off machine 33 so that the set-off machine can position the next set of flasks on the conveyor 20. The cope in the position 167 is held clear of the drag molding machine 34.

The drag and cope molding machines are essentially identical and are supported by a common frame on I-beams 172 bridging pit 173 and sand spill conveyors 174 and 175 running the entire length of the molding line.

Each molding machine includes a vertically movable table in which is incorporated a jolt mechanism. The table is moved vertically by hydraulic piston-cylinder assembly 178. Pattern plates are positioned on top of the table and may be readily be moved into and out of the machine by pattern change conveyors seen at 179.

On top of each machine there is provided a sand hopper 180. The lower end of each hopper is provided with a louvered gate which may be operated by piston-cylinder assembly 181 to permit sand to fall therethrough when opened through a power operated aerator and through a sand chute 182 positioned above the flasks somewhat elevated on the pattern plates. When the sand has filled the flask the piston-cylinder assemblies 182 are retracted to index the sand chute out of the way and to replace the chute with a squeeze head 183. The piston-cylinder assemblies 178 are then further elevated to squeeze the sand in the flask between the pattern on the bottom and the squeeze head on the top.

After the molding operation the table descends to place the flask with the mold therein on the conveyor and further lowering of the table draws the pattern from the bottom of the mold. The flasks with the molds therein are then repositioned on the idler rollers of the conveyor which extends through the frame of the molding machines. The molding machines are generally conventional and are of the type used in the high speed high volume production of foundry molds.

After the molds have been formed in the drag and cope flasks and the molds repositioned on the conveyor 20, and after the set-off machine has formed another set of flasks at the entrance of the conveyor, the locaters 168 and 169 are retracted and the mold line indexer is again actuated to move the flasks along the conveyor 20 in abutting fashion.

When the indexer indexes once again the flasks with the molds therein will be pushed from the drag and cope molding machines to the locations seen at 185 and 186 wherein the flasks will again be engaged by opposed sets of locaters or detent means seen at 187 and 188, respectively. The locaters 187 hold the drag flask with the mold therein in the location 185 clear of the cope molding machine 35 while the locaters 188 hold the cope flask with the mold therein in the location 186 clear of the drag rollover 37.

Bridging the locations 185 and 186 is the strike-off 36 which includes a blade 190 supported on arms 191 pivoted at 192. The arms are pivoted by piston-cylinder assembly 193 so that the blade may be brought into strike-off position adjacent the top surface of the drag in the location 185 when the piston-cylinder assembly is extended. The blade may be retracted by retraction of the piston-cylinder assembly to clear the top of the cope. The strike-off is mounted on a frame 194 extending from the frame of the cope molding machine to the top of the frame of the drag rollover.

The next time the indexer moves the drag and cope set along the conveyor 20 the drag will be positioned in the rollover 37 and the cope will be positioned in the location 196. In such location a pair of opposed locaters 197 will hold the cope clear of the rollover.

DRAG ROLLOVER

Referring now to FIGS. 11–15 in addition to FIGS. 1A and 2A, it will be seen that the drag rollover 37 includes a base frame 200 which serves not only to support the drag rollover, but also to support with considerable precision adjacent side rails of adjacent sections of the idler conveyor 20. For this purpose the top of the base frame is provided at each side with support brackets seen at 201, each of which includes two upstanding supports indicated at 202 and 203 for the conveyor rails. Each support includes a dowel pin 204 which is employed for accuracy in set-up and location before the side rails are secured by the fasteners seen at 205. The conveyor may be similarly supported at other locations therealong to obtain the length accuracy required.

Figure 12:
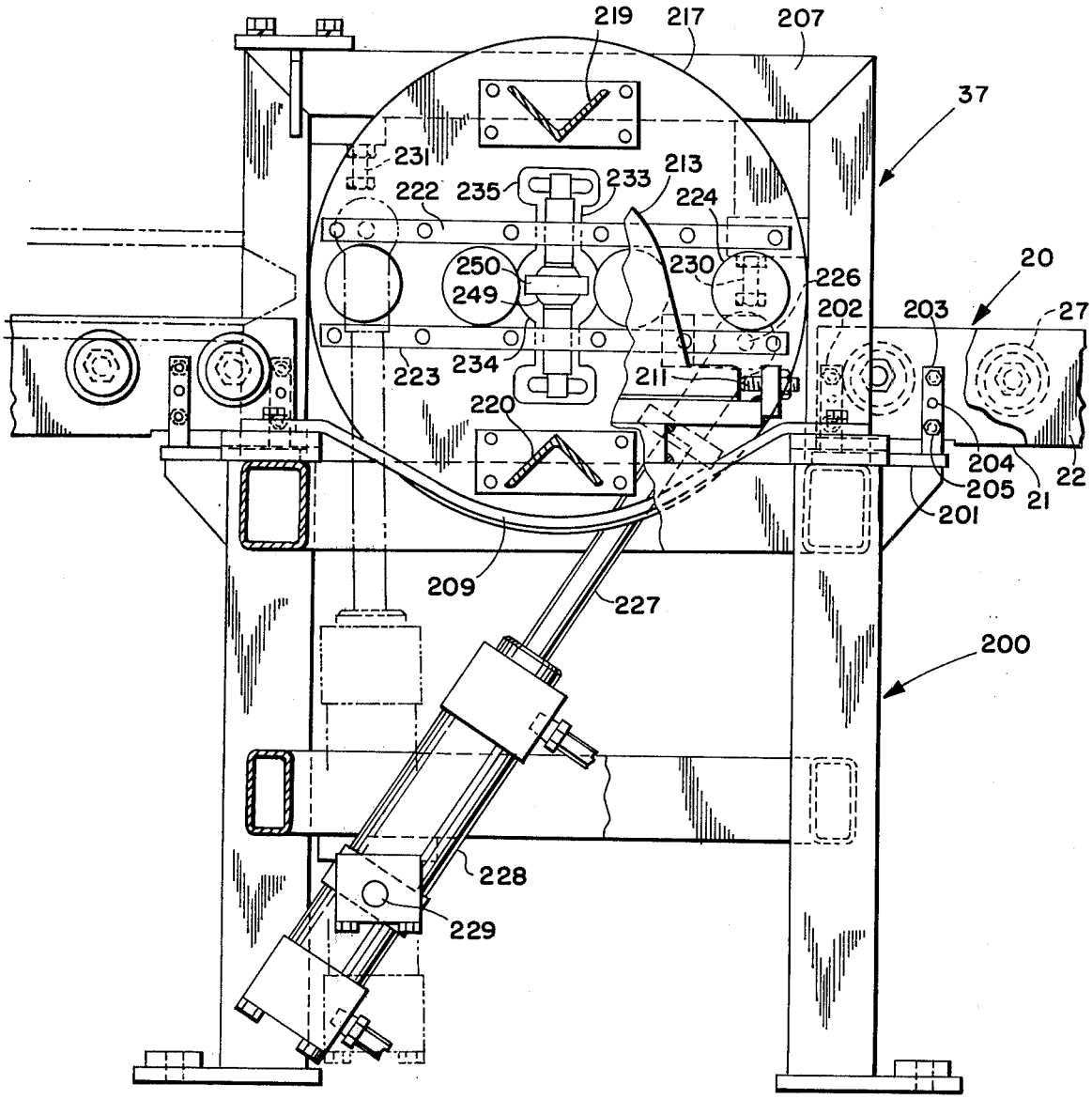
FIG. 12 is a further enlarged view partially in section and partially in elevation as seen from the line 12—12 of FIG. 11.

On top of the base frame 200 there is provided inverted U-shape end frames 207. The top of the base frame is also interconnected by straps 209 and 210 which are bowed downwardly as indicated in FIG. 12.

The top of the base frame includes opposed adjusting screws 211 which adjustably support at each end a pillow block as seen at 212 and 213 in which are journaled the trunnions 214 and 215 supporting rollover frame 216.

The rollover frame 216 comprises two circular end plates 217 and 218 interconnected by angles 219 and 220. Such angles are arranged symmetrically to preclude sand which may spill from being caught and retained. The inside of each end plate is provided with parallel guide rails as seen at 222 and 223 between which inwardly project four equally spaced diametrically arranged flangeless idler rollers 224. Such idler rolls are designed to fit closely between the top and bottom flanges on both the cope and drag flasks.

Pivotally connected to the exterior of the plate 217 at 226 is the eye of piston rod 227, the piston-cylinder assembly 228 of which is pivoted at 229 to the base frame 200. The piston-cylinder assembly 228 is preferably an air-over-oil assembly and retracts and then extends to invert the trunnion frame. Adjustable stops are provided as seen at 230 and 231 at the end of each extension stroke.

Each end plate is provided with an aperture indicated at 233 in FIG. 12. Each aperture includes a central circular portion 234 and diametrically opposed T-shape openings 235.

Figure 13:
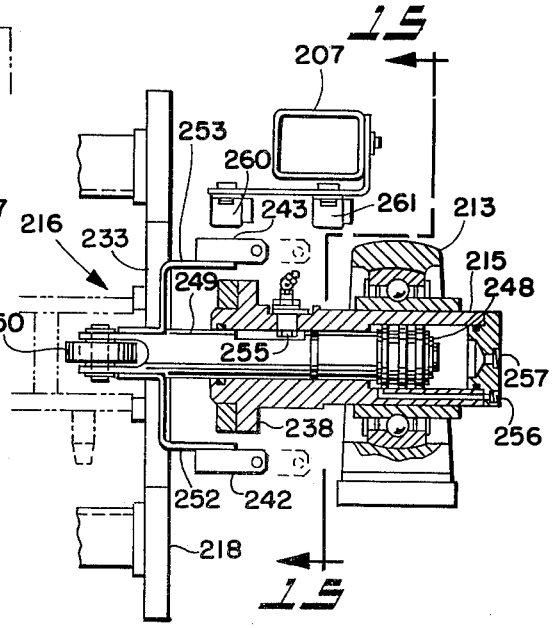
FIG. 13 is a fragmentary section through one of the rollover trunnions as seen from the line 13—13 of FIG. 11 illustrating the locater or detent means therein.

As seen more clearly in FIGS. 13 and 15, each trunnion is provided with a flange 238 to which is secured a four-legged spider or stool 239. The stool includes an annular plate having opposite V notches seen at 240 and 241 in FIG. 15. The notches accommodate magnets 242 and 243, respectively, and their supporting brackets. The four equally spaced legs of the stool seen at 244 secure the flange of the trunnion to the exterior of the circular rollover frame end plates. The arrangement provides the desired clearance with the T-shape extensions 235 of the aperture 233 as well as the fasteners 245 for the idler rolls closest to the circular portion 234 of the aperture 233. The trunnions are thus rigid axial extensions of the rollover frame 216.

As seen more clearly in FIG. 13, axially movable in each trunnion is a piston 248, the rod 249 of which projects inwardly of the trunnion and through the circular portion 234 of the aperture 233. The distal end of the rod 249 is bifurcated and a roller 250 is journaled between the projecting legs thereof. The distal end of the rod adjacent the roller is flattened and secured to such flats are the inner ends of brackets 252 and 253 supporting the magnets 242 and 243, respectively. The rod 249 is keyed against axial rotation within the trunnion 215 as indicated at 255. The piston may be pneumatically operated and is double acting though the ports 256 and 257.

The two magnets 242 and 243 trip switches 260 and 261 secured to the top frame member 207 to signal whether the locater roller 250 is in or out. A further magnet seen at 264 in FIG. 15 mounted on one of the end plates trips limit switch 265 to signal the piston-cylinder assembly 228 to go from pull to push.

In the position seen in FIG. 12, during index, the cope mold will be pushed completely through the drag rollover. The index stroke will, however, position a drag mold in the rollover within a predetermined tolerance. When the locaters are extended, the drag mold will be centered and locked in the rollover for inversion upon the retraction and extension of the piston-cylinder assembly 228. This will then invert the drag mold to place the pattern surface therein facing upwardly. When the inversion is complete, the locaters are withdrawn and the next index stroke may commence.

From the drag rollover the drag will then move upon index into the first coring area location seen at 267 in FIG. 1A or 2A. During successive index strokes the drag will move to the positions 268 and 269, all such positions being in the coring area 38. Thus the drag will be in position in the coring area for three cycles of the line which is adequate time to place cores in the pattern cavity of the drag.

When the drag is in the final position 269 the cope will be in the location 270 and held in such position by the opposed locaters 271.

The next time the drag and cope set is indexed, they will move into the close and set-on machine 39. Before index the cope and drag elevators will be in a position to receive the flasks. As the cope flask is indexed to the location 273 the drag flask will move to the location 274. With the cope elevator down, the top flange of the cope flask will move over the pick-up fingers of the cope elevator and when properly located by the opposed set of locaters 275 the cope will be elevated to the position shown. The closing machine 39, like the set-off machine 33, includes a relatively short powered roller conveyor section 276 which is powered through the clutch and brake drive 277 which may be the same as the drive 126 shown in detail in FIG. 4. During the index, the clutch and brake will be disengaged and released so that the conveyor section 276 will act as the remainder of the idler roller conveyor. However, after the cope is picked up, the conveyor section is energized to move the drag from the location 274 to the location 273 to be picked up after being located and centered by the opposed sets of locaters 275. When the drag is picked up it is closed against the bottom of the cope and the cope and drag assembly is lifted off of the cope pick-up fingers and brought to bear against the lower end of stop rods 279 to provide a controlled crush of the sand face between the cope and drag molds. Each stop rod, there being four in number, may be provided on its lower end with the relatively small piston-cylinder assemblies seen at 280 in FIG. 16, which include projecting plungers 281. This provides better control of the desired crush of the sand face between the cope and drag and may be employed on the close machine only. The stop rods as on the set-on machine 33 also serve to stabilize the cope and drag assembly as it is being transferred to the pallet conveyor 30 from the molding line. As seen more clearly in FIG. 16, the rods 279 may serve as a cylinder for the shouldered piston 280 held in place by threaded cap 282. The upper end of the rod or cylinder is secured to the carriage by end cap 283 secured in boss 284, the former being provided with port 285.

The closing machine 39 then simply transfers the finished mold to the conveyor 30 for pouring and cooling, and other than the detail discussed and operating in a reverse cycle, may be the same as set-on machine 33.

Figure 1B:
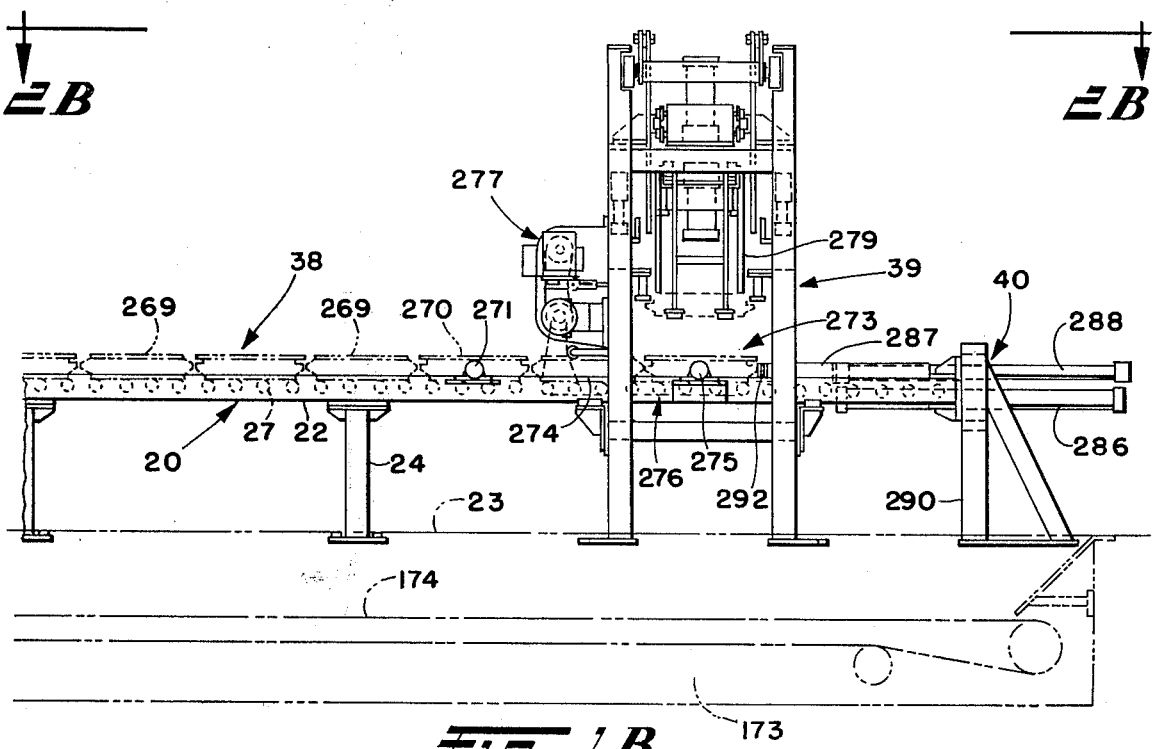

Upon completion of the closing operation, the locations 274 and 273 are empty. At this point, pneumatic cylinder 286 is energized moving control frame 287 to the left to occupy the locations 274 and 273. Also connected to the frame in parallel arrangement is an oil piston-cylinder assembly 288 used for control purposes in the same manner as the piston-cylinder assembly 45 of the indexing mechanism 32 on the opposite end of the molding line. The control mechanism 40 is mounted on the asymmetrical A-frame 290 which also serves to support the tail end of the molding line conveyor in cooperation with the frame of the closing machine 39. The frame 287 is U-shape in plan configuration as seen more clearly in FIG. 2B and the frame 290 may be provided with shock absorbers 291 to engage the legs of the frame when fully retracted or to the right as seen in FIGS. 1B and 2B. The opposite end of the frame may be provided with urethane or like material bumpers 292 for engagement with the cope flask in the location 270 when the mold line is next indexed. It will thus be seen that the indexer on the front end of the line is during index always pushing against the frame 287 as soon as any slack in the line is taken up; movement of the frame 287 to the right during index will of course be controlled by the flow of oil from the cylinder 288.

THE LOCATERS

In the illustrated embodiment there are seven sets of locaters in addition to the locaters employed on the rollover. The construction mounting and support for such locaters is shown in detail in FIGS. 9 and 10. Each locater is supported on an angle bracket 300 which includes a vertical flange 301 and a horizontal somewhat larger top flange 302. Such brackets are secured to the exterior of the conveyor rails 22 by dowel pins and fasteners and the studs of the idler rolls may project through enlarged holes therein. The brackets may be provided with triangular gussets 303 to provide a rigid horizontal support surface for the locaters.

The locater includes a cylindrical body 305 which includes two laterally extending wings 306 and 307 which are each secured by two fasteners seen at 308 and 309 extending through the wings and a slightly oversized slot 310 which extends through the flange 302, and a mounting pad 311 secured to the flange. Each mounting pad has an adjusting bar secured thereto as indicated at 319. In addition, relatively short stanchions are secured to the top of the flange as indicated at 321 and 322, such stanchions being aligned with the slot 310. The stanchions as well as the adjusting bar are provided with tapped apertures as indicated for the four adjusting screws 323 illustrated. The adjustment on each side of the cylinder is the same and with such adjustment the position of the cylinder can closely be adjusted either axially or laterally of its axis plus or minus approximately 0.25".

The cylinder 305 is provided with a bore 325 accommodating piston rod 326 and a somewhat larger contiguous and aligned bore 327 accommodating piston 328. Adjacent the shoulder formed between the bores, the bore 327 is provided with a circular channel 329 in communication with port 330. A further port is provided at 331 and the end of the cylinder is closed by cap 332.

The rod 326 projecting through the bore 325 is provided with a transverse slot 334 in its end accommodating roller 335 journaled by the roller bearing indicated on shaft 336. The shaft is held in place by a keeper 337 secured to one of the opposed flats 338 on the side of the end of the rod. The roller may be provided with a urethane or like elastomeric cover as indicated at 339.

The opposite end of the rod is provided with a resilient pad as seen at 341 held in place by a retainer on the projecting end of the rod beyond the piston. The end cap 332 is provided with a recess 342 to accommodate the rod end construction.

Figure 10:
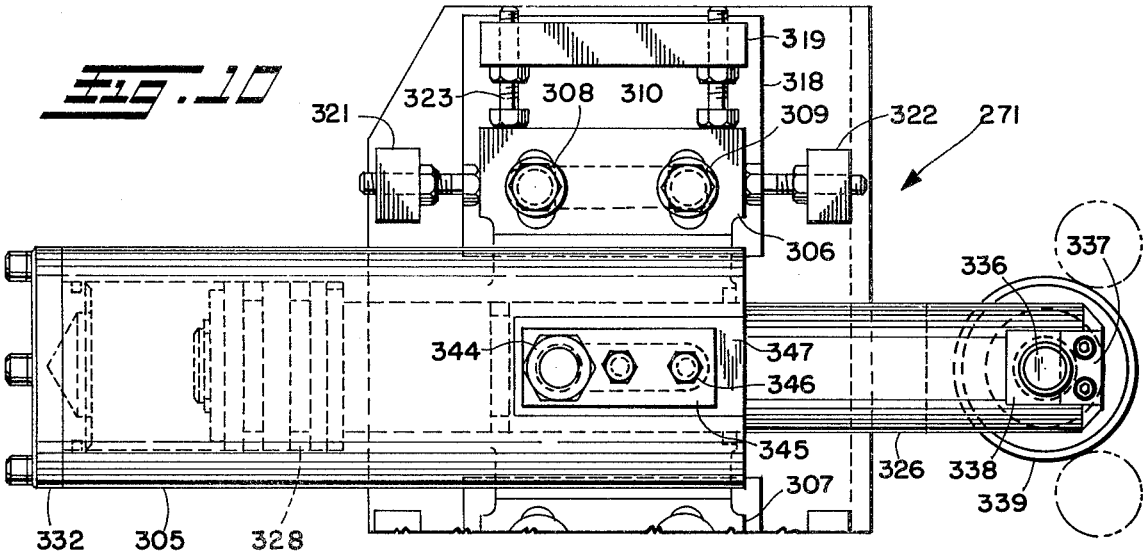
FIG. 10 is a top plan view partially broken away of the locater or detent means seen in FIG. 9 seen from the line 10—10 thereof.
Figure 11:
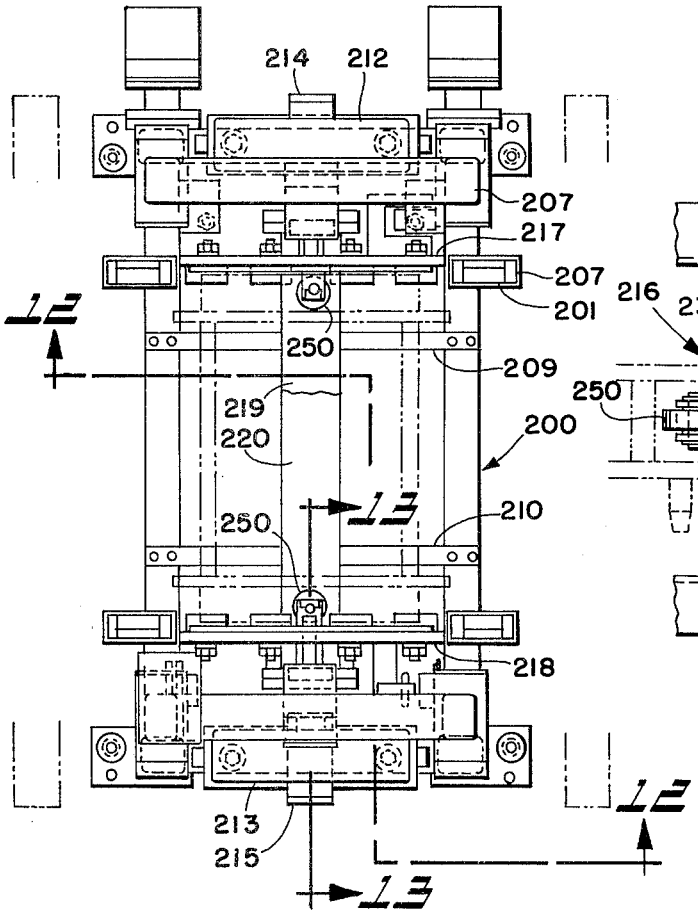
FIG. 11 is an enlarged top plan view of the drag rollover partially broken away.

The rod is provided with a slot 343 serving as a keyway to accommodate guide pin 344 serving as a key. The guide pin also has a passage therethrough and serves as a lubrication fitting. The guide pin is held in place by a pin retainer plate 345 secured by fasteners 346 to the flat 347 on the top of the cylinder. As illustrated, the piston and rod are both provided with seals and in addition, the rod is provided with a wiper adjacent the end of the cylinder. The piston-cylinder assembly thus provided is a double acting pneumatic piston-cylinder assembly which will extend and retract the rod and accordingly the roller mounted on the distal end thereof. The axis of the roller is of course vertical and is maintained in such vertical orientation to cooperate with the especially constructed cope and drag flasks supported on the idler rollers 27 as hereinafter described. It is the function of each locater to engage the flask and center it within a predetermined tolerance with respect to a specific position along the conveyor. The adjustments seen more clearly in FIG. 10 are designed both to achieve the precise location and to limit the projection of the roller in the extended position of the rod. It will be appreciated that if the rollers extend too far, they will push the flask to one side or the other of the conveyor causing the flask flange to bear against the flange of the idler rollers 27. Accordingly, even when the locaters are fully extended, there will still be a very slight play between the flask and locater roller to avoid loading the flanged idler rollers.

Figure 9:
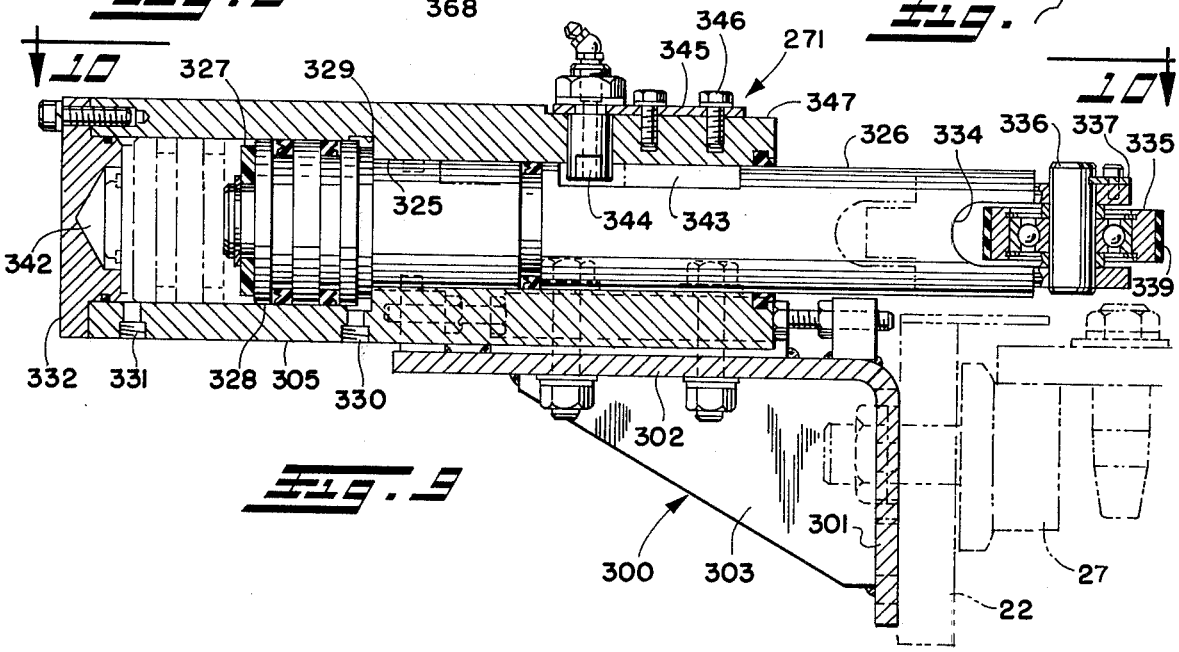
FIG. 9 is an enlarged vertical section of one of the locater or detent assemblies strategically positioned along the molding line as seen, for example, from the line 9—9 of FIG. 2B.

In comparing FIGS. 9 and 10 with FIG. 13, it will be seen that the locaters illustrated in the rollover trunnions are essentially of the same construction.

THE COPE AND DRAG FLASKS

Referring now to FIGS. 5–8, it will be seen that the cope and drag flasks are substantially similar yet have significant differences.

Figure 6:
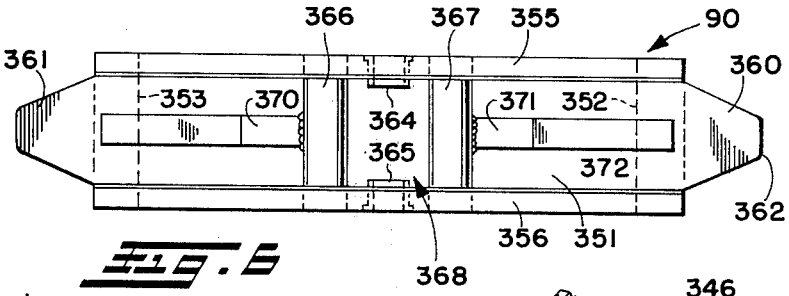
FIG. 6 is a side elevation of the drag flask as seen from the line 6—6 of FIG. 5.
Figure 7:
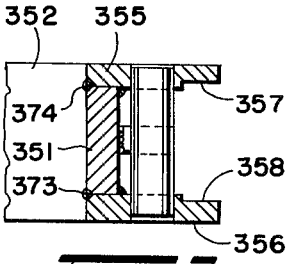
FIG. 7 is a fragmentary vertical section of the drag flask as taken from the line 7—7 of FIG. 5 illustrating one of the bars forming the locater receptacle on the side of the drag flask.

Referring first to the drag flask seen in FIGS. 5, 6 and 7 it will be appreciated that the flask includes sidewalls 350 and 351 interconnected by front and back walls 352 and 353 to form a rectangular box. As seen more clearly in FIGS. 6 and 7, the sidewalls are not as high as the front and back walls and are each provided with laterally projecting top and bottom flanges seen at 355 and 356, the top and bottom surfaces, respectively, being flush with the top and bottom surfaces of the front and back walls 352 and 353. As seen more clearly in FIG. 7, the outer edges interiorly of the flanges are recessed as seen at 357 and 358 to provide adequate clearance for the projecting rollers of the drag rollover 37. For the balance of the molding line, the flask will be supported on the exterior edges of such flanges by the idler rolls 26 or 27.

Each end wall projects beyond the front and back walls in a truncated triangular shape as seen at 360 and 361, the corners of the truncation being rounded as at 362 to form fore and aft laterally spaced bumpers by which the flask is indexed or pushed along by an adjacent flask or the indexing frame.

Each flange is provided with a centrally located guide bushing as seen at 364 and 365 to receive guide pins, hereinafter described, projecting from the cope when the flasks are closed. Such guide bushings may also be employed with guide pins for alignment purposes during the molding operation.

It is noted that the bushings are spaced inwardly of the shoulder of the recesses 357 and 358 and are centrally located between two vertically extending rods 366 and 367 which form a detent receptacle 368 therebetween for accommodating the roller of each locater. The locater rollers are of course journaled for rotation on an axis parallel to the pins and will be forced into the receptacle midway between the flanges 355 and 356. The pins may for example be approximately $1\frac{3}{8}''$ in diameter, on 4" centers providing a receptacle of $2\frac{5}{8}''$ compared to the O.D. of 3" for the locater rolls. The pins thus act as simplified and inexpensive camming surfaces cooperating with the rolls of the locaters properly to position the flasks at the various locations along the molding line.

In the event a flask moves into position with the locater roll already extended, linear cams are provided on the sidewalls 350 and 351 as shown at 370 and 371. Each cam is provided with an inclined surface as seen at 372 in FIG. 5. The force created by the index cylinder will be sufficient to cause an extended locater roll to ride up the inclined surface overcoming the air pressure behind the locater piston and the locater roll will then pop into the receptacle 368 performing its desired function.

The drag flask, but not the cope flask, is symmetrical about a horizontal mid-plane and is of the same configuration whether inverted or not. Thus the drag flask need be inverted only once during the entire cycle.

Both the cope and drag flasks may readily be fabricated by welding. It is noted that the flanges 355 and 356 are welded to the sidewalls with an interior projecting bead seen at 373 and 374 which may be employed as a sand lock to assist in retaining the compacted mold in the flask.

The cope flask 100 seen in FIG. 8 is generally similar and includes sidewalls 375 and front and back walls 376 and 377. The sidewalls are provided with top and bottom flanges seen at 378 and 379. The outer interior edges are recessed as seen at 380 to clear the rolls of the drag rollover. The sidewalls 375 project beyond the front and back walls to form projecting bumpers in the form of a truncated right triangle as seen at 381 and 382. This provides a clearance as indicated at 383 for the cope to move with respect to the cope pick-up shoes normal to the plane of the viewer of FIG. 8.

While the flanges 378 and 379 project laterally to the same extent and in the same manner as the flanges of the drag, the top flanges 378 also project slightly beyond the front and back walls 376 and 377 to create an overhang seen at 384 and 385 at each corner of the cope flask. It is such overhangs clear of the body of the flask both laterally and longitudinally by which the cope pick-up shoes engage and elevate or lower the cope flask.

The flanges 378 and 379 are also interconnected by the bars or rods 387 and 388 to form the central receptacle 390 for the locater rolls. Linear cams are also provided on each side of the bars of the same configuration as the cams of the drag as seen at 391 and 392. A guide pin 393 is secured to and projects centrally from the bottom flange midway between and longitudinally aligned with the circular rods 387 and 388. The guide pin is of course designed to fit into the guide bushings of the drag.

It should be understood that the flasks may be symmetrical about their horizontal midplane.

INDEX CONTROLS

The controls for the index piston-cylinder assemblies at the beginning of the conveyor and the control piston-cylinder assemblies at the end of the conveyor are essentially the same and accordingly only the index cylinder controls will be described in detail.

Figure 17:
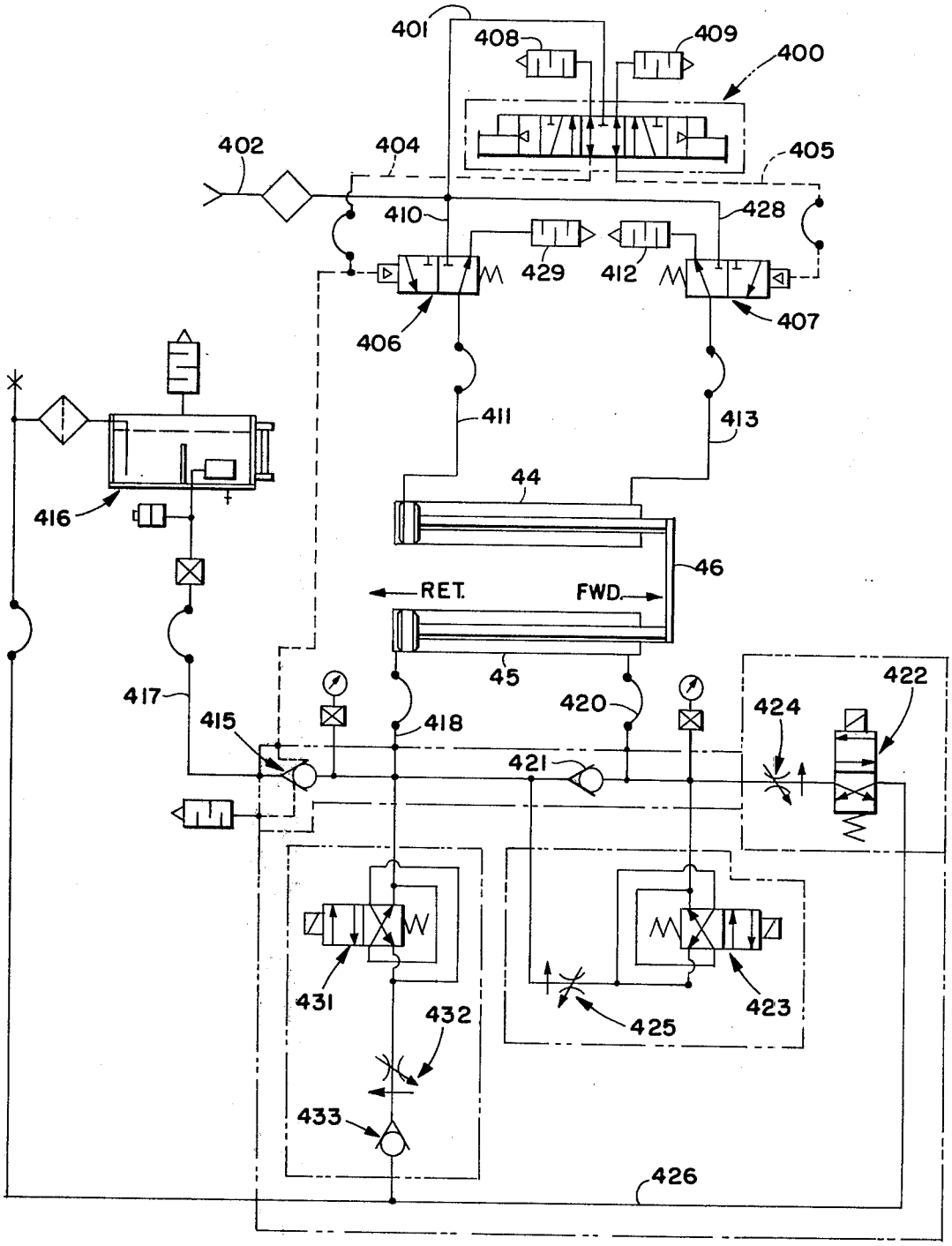
FIG. 17 is a schematic circuit diagram of the air-oil index and control mechanism for the molding line.

With reference now to FIG. 17 it will be seen that the relatively larger pneumatic piston-cylinder assembly 44 is controlled by a double solenoid three-position four-way valve 400. Air pressure is supplied to such valve through line 401 from source 402. Shifting of the valve from the neutral position will pressurize selectively pilot lines 404 or 405 opening normally closed poppet valves 406 or 407, respectively. In the neutral or centered position of the control valve 400 such pilot lines are vented through mufflers 408 or 409, respectively. When the poppet valve 406 is opened air pressure from source 402 will be supplied through the valve through lines 410 and 411 to the blind end of piston-cylinder assembly 44. When the poppet 406 is opened, the poppet 407 will remain closed venting the rod end of the piston-cylinder assembly 44 to atmosphere through muffler 412 and line 413. Pressure in pilot line 404 opening poppet 406 also opens air operated check valve 415 connecting oil reservoir 416 with the blind end of piston-cylinder assembly 45 through lines 417 and 418. The pistons of both cylinders now move forwardly with the piston of the hydraulic cylinder 45 now drawing oil from the reservoir into the blind end of the cylinder.

Oil in the cylinder 45 flows out through line 420 and, because of check valve 421, such oil must flow through either solenoid operated control valve 422 or solenoid operated control valve 423. If both are closed, as illustrated, the oil won't go anywhere and neither will the index cylinders. Closing both locks or stops the movement. Both control valves have in series therewith pressure compensated manually operated needle valves as seen at 424 and 425, respectively. The solenoid of the valve 422 may be manually operated and the needle valve 424 set at a slow speed. In this manner the index may be jogged forward for set-up, alignment, or for whatever purpose. When the valve 422 is open the oil will return to tank through the line 426.

During the automatic cycle of the machine the oil will normally flow through control valve 423 and the needle valve 425, the latter controlling the forward speed. Oil from the needle valve 425 simply replenishes the oil entering the blind end of the cylinder 45 through line 418.

To return the index mechanism, the control valve 400 is shifted in the opposite direction closing poppet 407 and supplying air from source 402 through line 428 and line 413 to the rod end of the cylinder 44. The blind end of the cylinder is now vented through muffler 429. Also, the check valve 415 is closed.

To control the speed of return, solenoid operated control valve 431 is shifted to permit oil from the blind end of the cylinder 45 to return to the reservoir through pressure compensated needle valve 432 and check valve 433. The check valve 433 is set at a higher pressure than the check valve 421 so that the excess volume of oil coming from the blind end of the cylinder 45 through the line 418 will serve simply to replenish the oil in the rod end of the cylinder.

With the closed circuit oil system illustrated, it will be appreciated that a variety of speeds or modes of operation may be obtained and also the index mechanism may be stopped at any point during its stroke.

With the control system illustrated and described it will be appreciated that the index cylinder mechanism and the control cylinder mechanism at the opposite end with the horizontal line of abutting flasks therebetween can be closely controlled to keep the flasks abutting and yet moving at the desired speed. On the forward stroke of the index mechanism, it not only has its own closed circuit hydraulic control, but it is also, to a degree, under the control of the closed circuit hydraulic flow of the hydraulic portion of the control cylinder assemblies.

OPERATION

Both the cope and drag flasks may be of the same horizontal dimension from bumper to bumper. Such dimension may, for example, be 23.940" plus 0.000 minus 0.030. The index mechanism may have a 50" stroke and use a 49" plus or minus 0.25" stroke. In this manner the stroke of the index mechanism is slightly longer than the horizontal dimension of a set of cope and drag flasks in abutting engagement. The control cylinder mechanism may have a stroke of 51" using approximately 40¾, plus or minus 0.25". Normally it is preferred to leave approximately 0.50" from the bottoming of the control cylinder at its blind end. In this manner there will be a minimum 0.625" of its stroke left at the rod end if all of the flasks are at minimum tolerance.

The stroke of the index mechanism is designed to center all of the flasks in the molding line in abutting arrangement at a nominal center seen at 450 in FIG. 18. At the center or index position there will be nine flasks ahead of the cope positioned at the index position and eight flasks behind it. After the index stroke, the actuation of the locaters will spread the flasks ahead of the index position to the left as seen in FIG. 18 and 19 and the locaters behind the index position will spread the flasks to the right.

In operation, the set-off 33 picks up the vertically stacked set of a cope and drag flask from the pallet conveyor 30 and moves them over the molding line. The cope elevator will interfit beneath the four corner pick-up points on the cope flask and as the drag elevator descends, the cope elevator will restrain the cope from descent. The drag is placed on the powered section of the conveyor at the entrance thereof and is moved to the rear as seen at 451. The cope is now placed in front of the drag. During the set-on, all of the down the line operations may be completed such as cope and drag molding, drag rollover, and closing. When these operations are complete all of the locaters are retracted.

Also, at the completion of the closing operation, the pusher frame 287 of the control cylinder assembly has moved to the position 452 to take up the gap caused by the removal of the cope and drag flasks from the locations 273 and 274. With the control cylinder extended, the index cycle may now commence.

All of the slack or gaps between the flasks is now taken up and the line of flasks on the conveyor is brought into abutting engagement with each other and with the frame 287. Continued extension of the index mechanism and controlled retraction of the pusher frame 287 move the line of flasks to the right until the approximate center thereof is at the center 450. With the index mechanism now extended to the position seen at 453, the locaters are actuated positioning and spacing the flasks in the various strategic locations for clearance and centering. The index mechanism is now retracted and when the powered section of the conveyor is clear at the set-on 33, a new set of flasks is positioned at the entrance to the mold line conveyor is previously described. The cycle is continuously repeated.

It will be appreciated that additional stations may be provided in the line such as flask punch out or cleaning, a further drag rollover, or various stations within the core setting area for automatic placement of cores.

It can now be seen that with the present invention there is provided a low cost, high speed production line for precision castings. With the present invention, production speeds of up to 360 molds per hour may be obtained.

The relatively simple flasks and molds are indexed by sets through the flask separating, molding, rollover, core setting and closing stations. The indexing system employs dual air and oil cylinders for smooth positive control.

Other modes of applying the principles of the invention may be employed, change being made as regards the details described, provided the features stated in any of the following claims or the equivalent of such be employed.

The embodiments of the invention in which an exclusive property or privilege is claimed are defined as follows:

1. A foundry molding system comprising an idler roller linear conveyor operative to support a row of cope and drag flask sets for horizontal movement therealong, index means at one end of said conveyor operative to index such sets therealong in abutting relationship a distance slightly more than the horizontal length of a single set, and locater means being spaced apart sufficiently on said conveyor operative to center and separate adjacent flasks in such row of flask sets and at certain locations along said conveyor, alternately with the operation of said index means, and control means at the other end of said conveyor against which such flasks are pushed by said index means whereby such sets can be closely controlled to keep the flasks abutting and together moving at a controlled rate during indexing thereof, said locater means including opposed sets of rollers operative to engage roller receiving receptacles in such flasks, said rollers being journalled for rotation about a vertical axis on the ends of the rods of piston-cylinder assemblies, and means to keep said rods from rotating.

2. A foundry molding system as set forth in claim 1 including means to adjust the position of each locater means both toward and away from the conveyor and along the conveyor.

3. A foundry molding system as set forth in claim 2 wherein each flask is flanged top and bottom, and spaced rods extending between said flanges forming such receptacles.

4. A foundry molding system as set forth in claim 1 wherein said index means and said control means include reciprocating flask engaging frames, and piston-cylinder means operative to reciprocate said frames.

5. A foundry molding system as set forth in claim 4 wherein each piston-cylinder assembly means includes a pneumatic piston-cylinder and a closed circuit hydraulic piston-cylinder assembly each connected to its respective frame, and means to control the flow of fluid from the latter to control the speed of the frames.

6. A foundry molding system as set forth in claim 1 wherein said idler roller conveyor comprises flanged idler rollers journaled on stub shafts.

7. Apparatus for producing foundry molds comprising a linear conveyor, a cope and drag flask set-off at one end of said conveyor operative to place the drag and the cope on such conveyor to form a horizontally abutting cope and drag set in line with previously formed sets supported by said conveyor thereby forming a row of flask sets, index means and control means at opposite ends of said conveyor, said index means operative to push such set and previously formed sets along the conveyor against said control means to maintain the sets in abutting relation, said control means yielding to said index means at a controlled rate for controlled movement of said sets, and a plurality of detent means being spaced apart sufficiently along said conveyor and cooperating with such cope and drag flasks at a plurality of stations along said conveyor to position and slightly separate adjacent flasks in such row of flask sets for at least molding, drag rollover, coring and closing, whereby such flask sets may be indexed intermittently along the conveyor in abutting relationship, said detent means including opposed sets of rollers cooperating with receptacles in the sides of the flasks, said rollers being journalled for rotation about a vertical axis on the ends of rods of piston-cylinder assemblies, and means to keep said rods from rotating.

8. Apparatus as set forth in claim 7 including a closing and set-on substantially similar to the set-off, and a short powered conveyor section at each to move the drag to or from vertical alignment with the cope.

9. Apparatus as set forth in claim 7 wherein said index and control means includes a piston-cylinder assembly operated index frame at one end of said conveyor and a piston-cylinder asembly operated control frame at the opposite end.

10. Apparatus as set forth in claim 9 including a closed circuit oil piston-cylinder assembly connected to each frame, and means to control the flow of oil from each end to control the speed of said frames.

11. Apparatus for producing foundry molds comprising a conveyor, a cope and drag flask set-off at one end of said conveyor operative to place the drag and the cope on such conveyor to form a horizontally abutting cope and drag set, index means operative to index such set and previously formed sets along the conveyor in abutting relation a distance slightly more than the horizontal length of a set, and a plurality of detent means along said conveyor cooperating with such cope and drag flasks at a plurality of stations along said conveyor to position and slightly separate such flasks for at least molding, drag rollover, coring and closing, whereby such flask sets may be indexed intermittently along the conveyor in abutting relationship, said detent means at the drag rollover comprising trunnions for a rollover frame whereby said detent means at the drag rollover positions a flask in said rollover frame and defines the rollover axis about which said frame is inverted.

12. A foundry molding system comprising a linear idler conveyor operative to support a row of cope and drag flask sets for horizontal movement therealong, said conveyor including a center point, a plurality of locaters on said conveyor at certain spaced locations therealong on opposite sides of said center point, and index means and control means at opposite ends of said conveyor operative to index such sets therealong a controlled distance until the approximate center of such row of sets is at said center point, said locaters being spaced apart sufficiently to separate adjacent flasks in such row of flask sets, and the locaters on one side of the center point moving the flasks on the same side in one direction while the locaters on the other side separate the flasks on such other side in the opposite direction, such movement of the flasks being progressively greater the further the flasks are from the center point.

13. A foundry molding system as set forth in claim 12 including a relatively short powered roller section at the entrance and exit of the idler conveyor operative to move a drag rearwardly and forwardly, respectively, for set off and closing, the former forming the cope and drag flask sets.

14. A foundry molding system as set forth in claim 13 wherein the roller receptacles in such flasks are formed by vertically extending spaced rods.

15. A foundry molding system as set forth in claim 12 wherein said locater means comprise opposed sets of rollers, and means to move said rollers toward and away from roller receptacles in the flasks.

16. A foundry molding system as set forth in claim 15 wherein said rollers of said opposed sets are journalled for rotation about a vertical axis on the ends of rods of piston-cylinder assemblies.

17. Apparatus as set forth in claim 11 further comprising aligned idler rollers at each end of said rollover frame adapted to fit between parallel projecting flanges on each end of a flask, and said detent means at the drag rollover including an axially movable locater operative to center and lock such flask in the frame during inversion.

18. Apparatus as set forth in claim 17 wherein said locater comprises a roller journaled for rotation normal to the axis of the trunnion and normal to the plane of alignment of the idler rollers.

19. Apparatus as set forth in claim 18 wherein said roller is journaled for rotation on the projecting end of a rod of a piston-cylinder assembly.

20. Apparatus as set forth in claim 19 wherein said cylinder of said piston-cylinder assembly is secured to said frame and is journaled in a pillow lock supporting said frame for inversion.

21. Apparatus as set forth in claim 20 including end plates on said frame, and a hole in at least one said end plate through which said roller projects.

22. Apparatus as set forth in claim 21 including switch means, and switch trip means secured to said rod to signal the position of said roller.

23. Apparatus as set forth in claim 18 including a roller locater at each end of said frame operative to center and lock a flask in the frame.

24. Apparatus as set forth in claim 17 including a piston-cylinder assembly operative to invert the frame, said piston-cylinder assembly initially retracting and then extending to obtain inversion, and switch means operative to reverse the piston-cylinder assembly at the mid-point of inversion.

25. A foundry molding system as set forth in claim 1 further comprising foundry flasks adapted to be moved along said conveyor, each flask including a centrally located centering receptacle, and said locater means including a laterally movable locater operative to engage said flask at said receptacle to center and retain the same at a given location along said conveyor.

26. A foundry molding system as set forth in claim 25 wherein said flask includes top and bottom lateral flanges, said receptacle being formed by circular section rods extending between said flanges.

27. A foundry molding system as set forth in claim 25 wherein the locater is a laterally movable roller.

28. A foundry molding system as set forth in claim 25 wherein each roller is journaled for rotation about a vertical axis on the end of a rod of a piston-cylinder assembly.

29. A foundry molding system as set forth in claim 26 wherein some of said flasks are symmetrical about their horizontal mid-plane.

30. A foundry molding system as set forth in claim 26 wherein each flask has front, back and side walls and the top flange of some of the flasks extend fore and aft the front and back walls thereof.

31. A foundry molding system as set forth in claim 26 wherein each flask has front, back and side walls and the side walls of each flask extend fore and aft the front and back wall to form bumpers.

32. A foundry molding system comprising an idler roller linear conveyor operative to support cope and drag flask sets for horizontal movement therealong, index means at one end of said conveyor operative to index such sets therealong in abutting relationship a distance slightly more than the horizontal length of a single set, and locater means on said conveyor operative to center and separate such flasks at certain locations along said conveyor, alternately with the operation of said index means, control means at the other end of said conveyor against which such flasks are pushed by said index means whereby such sets can be closely controlled to keep the flasks abutting and together moving at a controlled rate during indexing thereof, and foundry flasks adapted to be moved along said conveyor, each flask including a centrally located centering receptacle, and said locater means including a laterally movable locater operative to engage said flask at said receptacle to center and retain the same at a given location along said conveyor, said flask including top and bottom lateral flanges, said receptacle being formed by circular section rods extending between said flanges, the spacing between said rods being less than the width of said locater.

33. A foundry molding system comprising an idler roller linear conveyor operative to support cope and drag flasks sets for horizontal movement therealong, index means at one end of said conveyor operative to index such sets therealong in abutting relationship a distance slightly more than the horizontal length of a single set, locater means on said conveyor operative to center and separate such flasks at certain locations along said conveyor, alternately with the operation of said index means, control means at the other end of said conveyor against which such flasks are pushed by said index means whereby such sets can be closely controlled to keep the flasks abutting and together moving at a controlled rate during indexing thereof, and foundry flasks adapted to be moved along said conveyor, each flask including a centrally located centering receptacle, and said locater means including a laterally movable locater operative to engage said flask at said receptacle to center and retain the same at a given location along said conveyor, said locater being a laterally movable roller, and the sides of each flask including a linear cam for said roller fore and aft the receptacle.

34. Apparatus for producing foundry molds comprising a linear conveyor, a cope and drag flask set-off at one end of said conveyor operative to place the drag and the cope on such conveyor to form a horizontally abutting cope and drag set in line with previously formed sets supported by said conveyor, index means and control means at opposite ends of said conveyor, said index means operative to push such set and previously formed sets along the conveyor against said control means to maintain the sets in abutting relation, said control means yielding to said index means at a controlled rate for controlled movement of said sets, a plurality of detent means along said conveyor cooperating with such cope and drag flasks at a plurality of stations along said conveyor to position and slightly separate such flasks for at least molding, drag rollover, coring and closing, whereby such flask sets may be indexed intermittently along the conveyor in abutting relationship, a frame straddling said conveyor, a reciprocating carriage mounted on said frame to and from a position over said conveyor, an elevator mounted on said carriage, a drag pick-up mounted on said elevator, a cope pick-up mounted on said frame and vertically aligned with said drag pick-up in a position of said carriage over said conveyor, and means to move said cope pick-up vertically independently of said elevator.

35. Apparatus as set forth in claim 34 wherein said cope pick-up vertically interfits with the cope whether moved with said carriage on top of the drag or moved to or from the transfer on said conveyor depending on the vertical position of the cope pick-up.

36. Apparatus as set forth in claim 34 including a vertically oriented piston-cylinder assembly for moving said cope pick-up vertically, said carriage including a recess in which said assembly fits when said carriage is over said conveyor.

37. Apparatus as set forth in claim 34 including vertically extending cope hold down rods secured to said carriage operative to provide a stop for the cope when elevated on the drag by said drag pick-up.

38. Apparatus as set forth in claim 37 wherein each rod includes a pressure operated piston at its lower end.

39. Apparatus as set forth in claim 34 wherein said cope pick-up includes parallel frames on each side of the path of movement of said elevator.

40. Apparatus as set forth in claim 37 wherein each frame includes at each end an L-shape arm having short and long legs, the short leg of the arm projecting horizontally toward the center of a cope supported thereby.

41. Apparatus as set forth in claim 40 wherin the long leg of the arm projects vertically and clears the cope whether moved laterally or longitudinally with respect thereto.

42. Apparatus as set forth in claim 39 wherein each of said parallel frames is supported for vertical movement by a vertically extending link, a laterally spaced pair of arms supporting said links at one end and interconnected at the other end by a squaring shaft.

43. Apparatus as set forth in claim 42 wherein said vertically orientated piston-cylinder is connected to said arms to pivot the same intermediate said ends thereof.

44. Apparatus as set forth in claim 34 wherein the pick-up and deposit elevations of said drag pick-up are different, said elevator on said carriage being powered by a tandem piston-cylinder assembly, one being extended to obtain one elevation, and both being extended to obtain the other.

* * * * *